US006814301B2

(12) United States Patent
Boecking

(10) Patent No.: US 6,814,301 B2
(45) Date of Patent: Nov. 9, 2004

(54) FUEL INJECTOR HAVING A HIGH-PRESSURE-RESISTANT SUPPLY LINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 113 days.

(21) Appl. No.: 10/189,122

(22) Filed: Jul. 2, 2002

(65) Prior Publication Data

US 2003/0080217 A1 May 1, 2003

(30) Foreign Application Priority Data

Jul. 4, 2001 (DE) ..... 101 32 246

(51) Int. Cl.[7] ..... F02M 47/02; F02M 39/00; B05B 1/30

(52) U.S. Cl. ..... 239/88; 239/533.3; 239/533.7; 239/533.8; 239/585.1; 239/585.5

(58) Field of Search ..... 239/88, 89, 90, 239/91, 92, 93, 533.2, 533.3, 533.7, 533.8, 533.9, 585.1–585.5; 251/129.15, 129.21, 127

(56) References Cited

U.S. PATENT DOCUMENTS 3,797,753 A * 3/1974 Fenne et al. ..... 239/533.8
4,993,637 A * 2/1991 Kanesaka ..... 239/96
5,186,138 A * 2/1993 Hashimoto ..... 123/198 DB
5,299,919 A * 4/1994 Paul et al. ..... 417/387
5,397,055 A * 3/1995 Paul et al. ..... 239/124

FOREIGN PATENT DOCUMENTS

DE 196 50 865 6/1998

* cited by examiner

*Primary Examiner*—Davis Hwu
(74) *Attorney, Agent, or Firm*—Kenyon & Kenyon

(57) ABSTRACT

The present invention relates to an injector for injecting fuel into the combustion chamber of an internal combustion engine. The injector (1) is actuated by an actuator (29) and includes a central chamber (5, 44), through which fuel under high pressure enters into a control chamber (3) that activates a nozzle needle (4). The central chamber (5, 44) is connected via a connector (7) to a high pressure source. In the injector body (13) between the central chamber (5, 44) and an end face (38) on the connector (7) are configured supply-line bores (30, 31), whose diameters (33, 34) are many times smaller than the diameters (36, 45) of the central chamber (5, 44).

9 Claims, 5 Drawing Sheets

Figure 1:
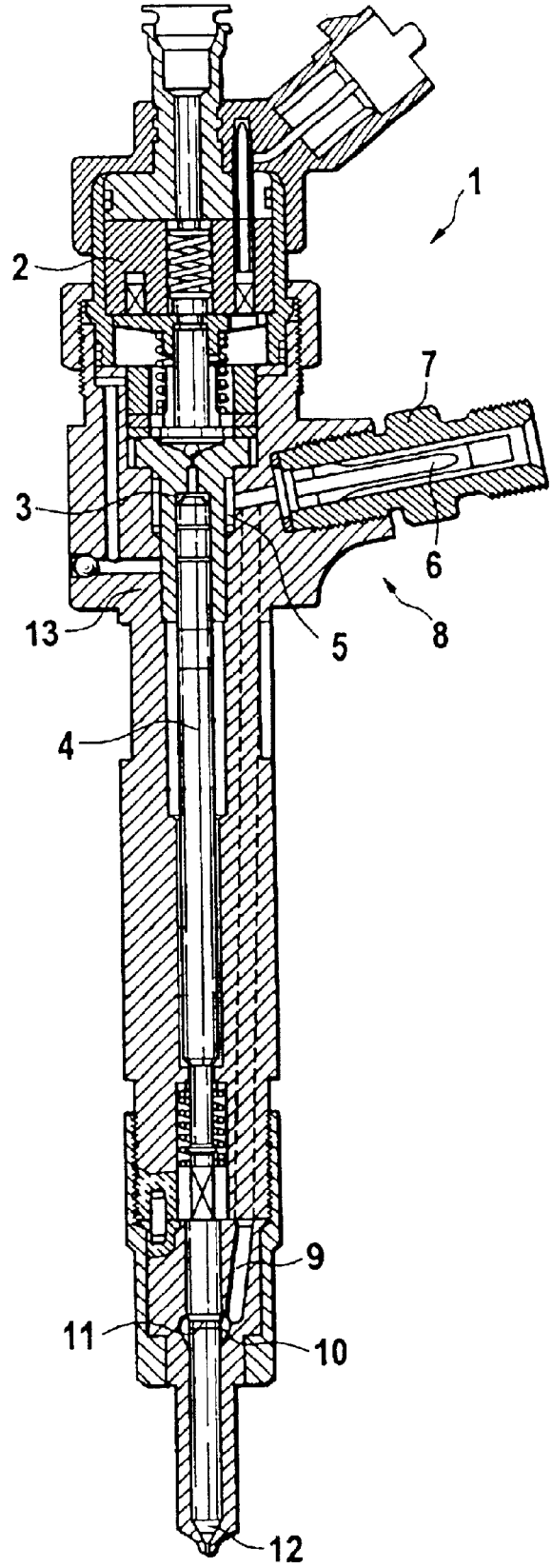

Fig. 5.1
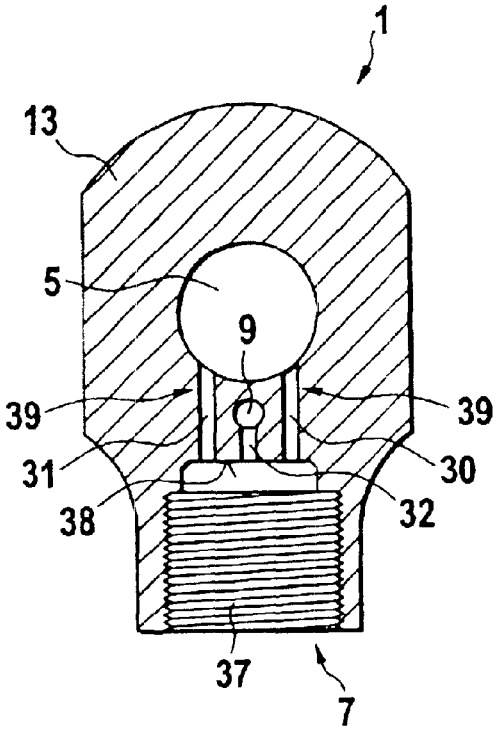
Fig. 5.2
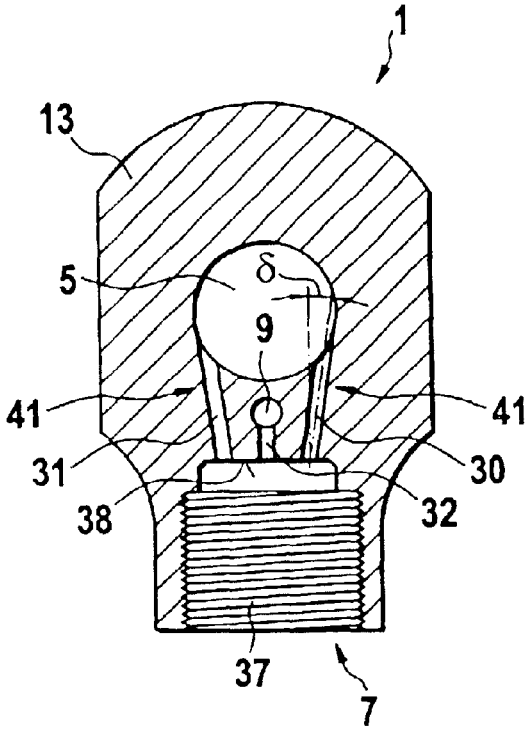
Fig. 5.3
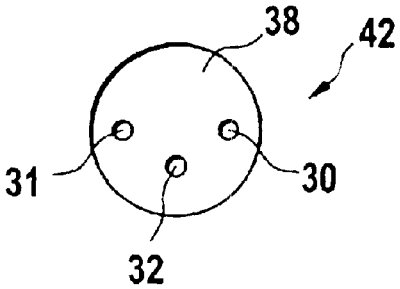
Fig. 5.4
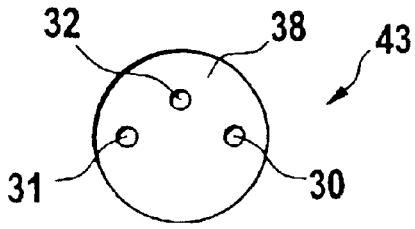

FUEL INJECTOR HAVING A HIGH-PRESSURE-RESISTANT SUPPLY LINE

FIELD OF THE INVENTION

In direct-injection internal combustion engines, fuel-injection systems are increasingly used that have a high-pressure collecting chamber (common rail). As a result of a high-pressure pump that permanently acts upon the high-pressure collection chamber, a virtually constant, high pressure level is maintained in the chamber. The fuel stored at high pressure in the high-pressure collection chamber is conveyed to the fuel injectors, which are assigned individually to the individual combustion chambers of the internal combustion engine. Therefore, increased demands with respect to high-pressure resistance are being placed on the fuel injectors, the supply lines from the high-pressure collection chamber as well as their connection points, and the supply system within the injector.

BACKGROUND INFORMATION

German Patent 196 50 865 A1 relates to a solenoid valve for controlling a fuel injector. A solenoid valve is proposed, whose magnet armature is configured in multiple parts, and which has an armature disk as well as an armature pin, which is guided in a sliding bloc. In order to avoid a backlash of the armature disk after the solenoid valve is closed, a damping device is provided on the magnet armature. Using a device of this type, it is possible to precisely maintain and reproduce the necessary short switching of the solenoid valve. The solenoid valve is designed for use in injection systems having a high-pressure collection chamber (common rail).

In accordance with this solution, a connection for a supply line from the high-pressure collection chamber is accommodated on the valve housing so as to be oriented diagonally, thus making it possible to achieve an improvement in the high-pressure resistance of a fuel injector. However, the improvement in the high-pressure resistance that can be achieved using this measure remains unsatisfactory, because, with respect to a further increase in the pressure level in the high pressure collection chamber (common rail), the increase in high-pressure resistance achieved by this measure may well be exhausted in the wake of further developmental advances.

PRESENTATION OF THE INVENTION

In contrast to the configuration of a single supply-line bore leading to the central bore, or to the annular chamber of a fuel injector, the solution according to the present invention proposes executing a plurality of supply-line bores that have an essentially smaller diameter than that of the bore, or the annular chamber. The advantage of this solution, which favorably influences the high-pressure resistance of a fuel injector, can be seen in the fact that the two or more supply-line bores can be configured as having an essentially smaller bore diameter. The greater the difference that can be maintained between the diameters of the supply-line and the central bore, or of the annular chamber in the fuel injector, the more favorable will be the high-pressure resistance in the fuel injector.

With regard to the central bore, or to an annular chamber configured in the injector body of the fuel injector, the supply-line bores can run parallel to each other in the injector body; in addition, it is also possible to arrange the supply-line bores to run at an angle δ diagonal to the central bore, or to the annular chamber of the fuel injector. Angle δ can be selected so as to be between 0° (the parallel position of the supply-line bores in the injector body with respect to each other) and a position in which the supply-line bores run tangentially with respect to the wall of the central bore, or of the annular chamber in the injector body, and discharge into the annular chamber or the central bore.

In addition to two or more supply-line bores leading to the central bore of the injector body, or its annular chamber, it is possible to configure in the injector body a further bore of a smaller diameter that directly acts upon the nozzle supply-line leading to the injection nozzle, it being possible to configure the bore leading to the two aforementioned supply-line bores in the ½ hole pattern, above or below at a distance, corresponding, for example, to half the distance between the supply-line bores in the injector body.

Using this configuration of the two or more supply-line bores in the interior of the injector body downstream of the connection point for the supply-line from the high-pressure collection chamber (common rail), the high-pressure resistance of the injector can be significantly increased. If the supply-line bores in the interior of the injector body are additionally subjected to an interior rounding-off, it is possible to achieve further resistance reserves, which make possible a further increase in the pressure level in the high-pressure injection system having a high-pressure collection chamber (common rail).

DRAWING

On the basis of the drawing, the present invention is described in greater detail below.

Figure 2:
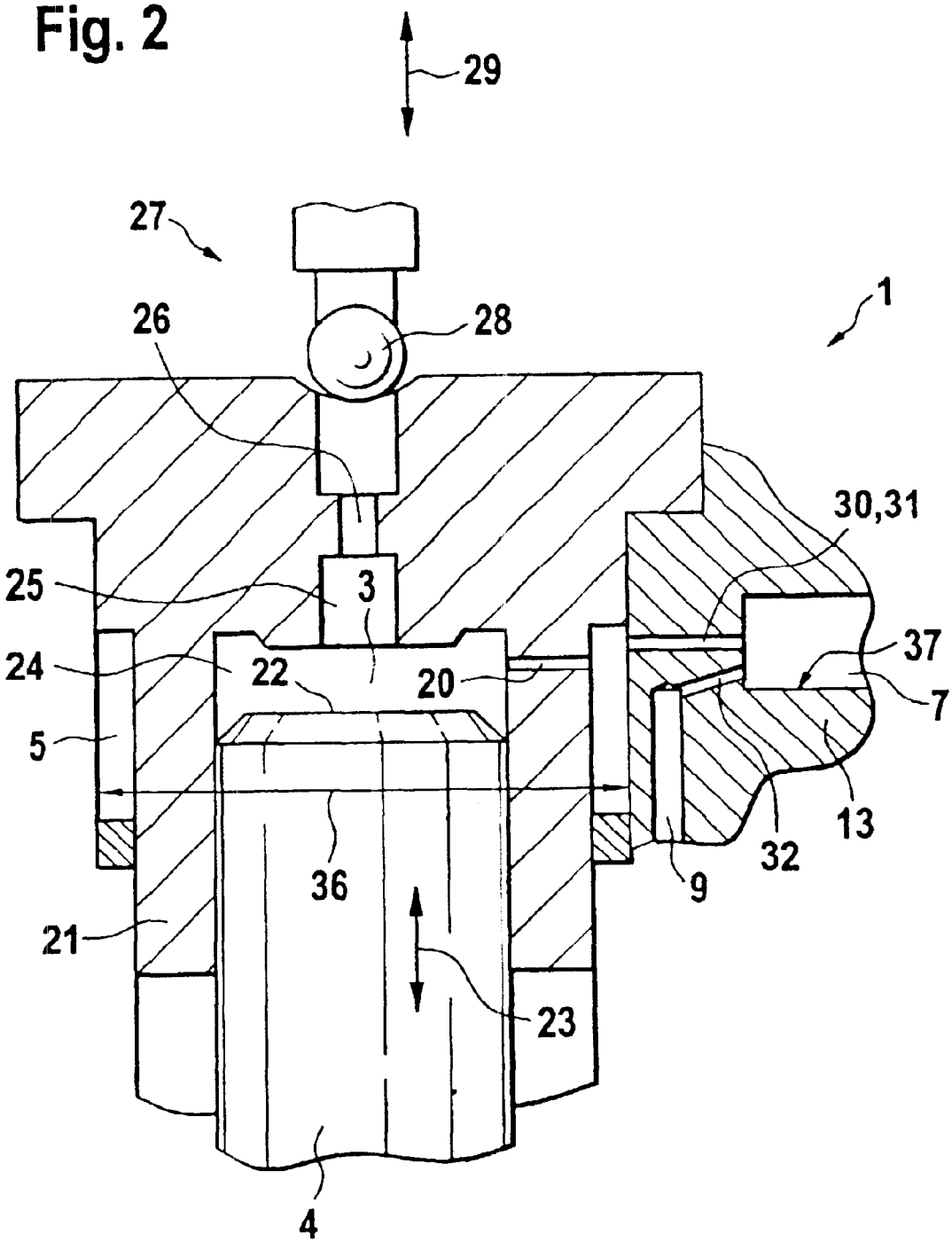
Figure 3:
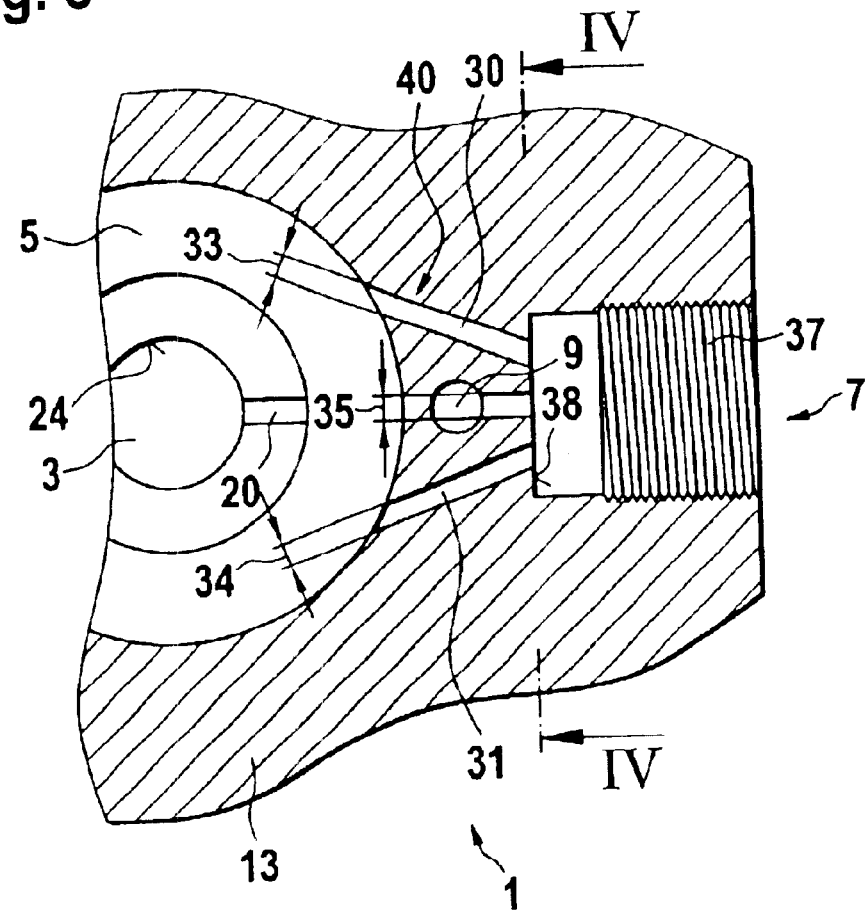
Figure 4:
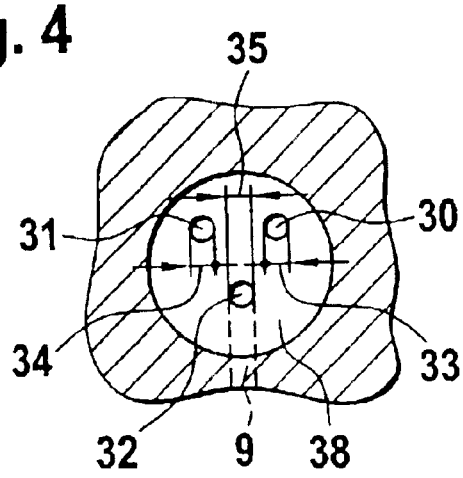
Figure 6:
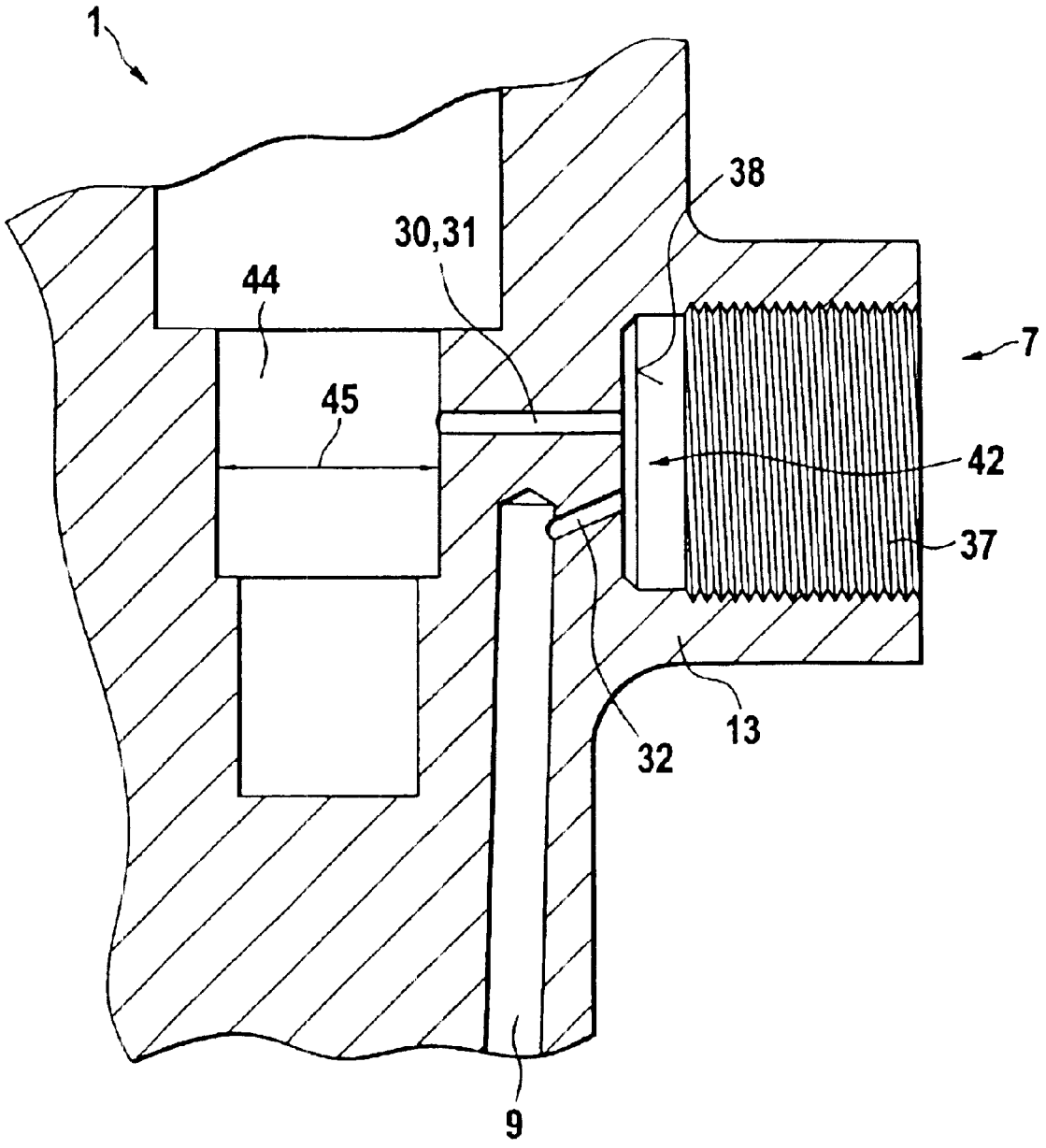

The following are the contents:

FIG. 1 depicts a fuel injector known from the related art having a diagonal high-pressure connection, FIG. 2 depicts a longitudinal section of an injector according to the present invention having an annular chamber in the interior of the injector body, FIG. 3 depicts a cutaway section of the representation according to FIG. 2, FIG. 4 depicts the view according to the cutaway section "A—A", FIG. 5.1 depicts a design variant having parallel supply-line bores in the injector body, FIG. 5.2 depicts a further design variant having tilted supply-line bores in the injector body, FIGS. 5.3+5.4 depicts supply-line bores for annular chamber/central bore and nozzle supply-line in ½ hole pattern, and FIG. 6 depicts central bores in supply-line bores discharging into a central bore of the injector body.

DESIGN VARIANTS

FIG. 1 depicts a fuel injector that is known from the related art and that has a tilted high-pressure connection.

Injector 1, which is known from the related art, includes an actuator in the form of a solenoid valve 2, by which a control chamber 3 can be relieved of pressure. Through the build-up or release of pressure in control chamber 3, a stroke motion is provided to a valve needle 4, which is accommodated in injector body 13 so as to be vertically movable. Control chamber 3 is surrounded by an annular chamber 5, which, via a connection piece 7 oriented in the representation according to FIG. 1 in tilted position 8, is connected to a high-pressure source, undepicted here, e.g., a high-pressure collection chamber or a high-pressure pump. A filter element 6, here indicated only schematically, is inserted into the end of connection piece 7. Configured in the lower area of injector body 13 of fuel injector 1 is a nozzle supply-line 9, which discharges into a nozzle chamber 10. In the area of nozzle chamber 10, nozzle needle 4 is provided with a pressure step 11. At the tip of nozzle needle 4, i.e., at the end of fuel injector facing the combustion chamber, nozzle needle 4 is configured as a tapered cone, and its nozzle needle tip 12 covers the injection openings that discharge into the combustion chamber of an internal combustion engine.

FIG. 2 depicts a longitudinal section of an injector according to the present invention, an annular chamber being configured in the injector body.

Injector 1 includes the aforementioned control chamber 3, which borders on a control-chamber wall 24. Extending into control chamber 3 is an end face 22 of nozzle needle 4, which is actuated in the vertical direction by a pressure build-up or pressure release of the control chamber, in accordance with drawn-in double arrow 23. Nozzle needle 4 is guided by guide surfaces 21; annular chamber 5, surrounding control chamber 3 in which the pressure can be released, is supplied with fuel via a connection piece 7 that is here indicated only schematically, and that is under very high pressure. Arranged between annular chamber 5 in injector body 13 and control chamber 3 is a fuel intake throttle 20, using which control chamber 3 is continually acted upon by a control volume from annular chamber 5. Configured opposite end face 22 of nozzle needle 4 is an outlet opening 25, to which is connected an outlet throttle 26. Outlet opening 25, and outlet throttle 26, are opened and closed using an outlet valve 27, which includes a closing body 28, which is configured in the representation according to FIG. 2 in a conical fashion. Outlet valve 24 is actuated by an actuator 29, that is not depicted here, whether it is a solenoid valve or a piezo actuator.

Supply-line bores 30, 31 are introduced in injector body 13 between connection piece 7 for the supply line from the high-pressure collection chamber (common rail) and annular chamber 5. The diameter of supply-line bores 30, 31 in injector body 13 is many times smaller than diameter 36 of annular chamber 5 in injector body 13. Via supply-line bores 30, 31, annular chamber 5 is supplied with fuel that is under high pressure via connection piece 7, on which an internal thread 37 is configured. In injector body 13, it is possible to introduce a further bore 32 that is configured to have a small diameter, in comparison with the diameter of annular chamber 5, via which a nozzle supply-line 9, which extends to the nozzle chamber in injection body 13, undepicted FIG. 2, can be directly supplied with fuel that is under high pressure.

FIG. 3 depicts a cutaway view of the representation of the injector according to the present invention as shown in FIG. 2.

In the cutaway view depicted in FIG. 3, supply-line bores 30, 31 are configured so as to be tilted toward each other, extending from an end face 38 on connection piece 7 to a central opening in injector body 13, the central opening being configured as an annular chamber 5. Configured between supply-line bores 30, 31 is a further bore 32 that directly acts upon nozzle supply-line 9. Common to supply-line bores 30, 31 as well as further bore 32 is that they all are configured as having a diameter 33, 34, 35, which is many times smaller than the diameter of the central opening—configured here as an annular chamber 5—of injector body 13. From annular chamber 5, control chamber 3, of which only its inner wall 24 is depicted here, is supplied via supply-line throttle 20 with fuel that is under high pressure and that collects in annular chamber 5 of injector body 13.

FIG. 4 depicts the view of cutaway section A—A according to FIG. 3.

From this representation can be seen a front view of end face 38 on connection piece 7, which can optionally be provided with a connection thread 37. According to this representation, supply-line bores 30, 31, that are executed as having small diameters 33, 34 and that act upon central opening 5 of injector body 13, are arranged next to each other, whereas further bore 32, also configured as having a small diameter 35 and acting upon nozzle supply 9, is situated between them at roughly half the distance and is configured so as to be below two supply-line bores 31, 30 in end face 38 on connection piece 7.

The representation according to FIG. 5.1 shows a design variant of the supply-line bores in the injector body, having supply-line bores that run parallel.

Annular chamber 5—the central chamber in injector body 13, which is not reproduced here according to scale—is supplied with fuel under high pressure from connection piece 7 via two supply-line bores 30, 31, in this case having an angle of tilt of $\delta=0$, i.e., running parallel to each other. Further bore 32, also configured in end face 38, acts upon nozzle supply-line 9 running perpendicular to the plane of the drawing, using fuel under high pressure. The parallel position of two supply-line bores 30, 31 is indicated by reference numeral 39.

FIG. 5.2 depicts a further design variant of the solution according to the present invention having supply-line bores running in the injector body that are configured at an angle with respect to each other.

Annular chamber 5, also reproduced here not according to scale, by analogy to the representation in FIG. 5.1, is also acted upon by fuel under extremely high pressure entering at connection piece 7, via two supply-line bores 30, 31, whose diameter is many times smaller than diameter 36 of annular chamber 5. According to this design variant, further bore 32 can be configured symmetrically with respect to the central line of connection piece 7, on which an interior thread 37 can optionally be configured. In contrast to the design variant according to FIG. 5.1, supply-line bores 30, 31 can be arranged at an angle $\delta$ (reference numeral 40) that runs diagonally with respect to the line of symmetry of connection piece 7 in valve body 13. The tilted position is identified by reference numeral 41. The maximum tilted position of supply-line bores 30, 31 between end face 38 and supply-line bores 30, 31 acting upon the central opening—configured here as annular chamber 5—is limited by the shape of the wall of annular chamber 5. Maximum tilted position 41 is stipulated by the tangential discharge of supply-line bores 30, 31 into the wall of the central chamber in injector body 13—whether it is an annular chamber 5 or a central bore 44.

FIGS. 5.3 and 5.4 indicate supply-line bores for annular chamber/central bore and nozzle supply-line in injector body in ½ hole pattern.

In FIG. 5.3, end surface 38 on connection piece 7 is depicted in a top view, further bore 32 being arranged in a ½ hole-distance between supply-line bores 30, 31 below two supply-line bores 30, 31. This ½ hole pattern is designated as reference numeral 42 (compare the representation in FIG. 4).

Apparent from the representation according to FIG. 5.4 is a further ½ hole pattern of supply-line bores 30, 31 on end surface 38. According to this design variant, further bore 32 is situated at half the distance, above two supply-line bores 30, 31, which extend from end face 38 perpendicular to the plane of the drawing into injector body 13 of fuel injector, in accordance with the representations in FIGS. 5.1 and 5.2.

FIG. 6 depicts a central bore on the injector body, the bore in this design variant constituting the central chamber in the injector body.

Analogously to the representation in FIG. 2, two supply-line bores 30, 31, only one of which is depicted for illustrative purposes, run from end surface 38 in connection piece 7 to a central bore 44. Central bore 44 in injector body 13 is configured as having a diameter 45, which by analogy to the representation in FIG. 2 exceeds by many times diameter 33, 34 (compare the representation in FIG. 4) of supply-line bores 30, 31. The same applies to further bore 32, which extends from the end surface on connection piece 7 to nozzle supply-line 9, via which a nozzle chamber, not depicted in FIG. 6, is acted upon by fuel under extremely high pressure.

Inherent in the design variants sketched in FIGS. 2 through 6 of the solution according to the present invention is the advantage that supply-line bores 30, 31 and a further bore 32 in the interior of injector body 13 are all configured as having diameters 33, 34, 35, which are many times smaller than diameters 36, 45, of central chambers 5, 44 that are acted upon by these bores 30, 31, 32. The greater the difference that can be maintained with respect to the diameters of supply-line bores 30, 31 in relation to the diameters of central openings 5, 44 in injector body 13, the better is the high-pressure resistance of the fuel injector. If supply-line bores 30, 31 are subjected to a production-technical treatment with respect to an interior rounding-off, then even greater high-pressure resistances can be achieved. Accordingly, the solution proposed in accordance with the present invention offers a potential resistance in fuel injectors which will be required due to the pressure increases that are promised in the future in the injection systems of direct-injecting internal combustion engines. This solid high-pressure resistance potential, which is inherent in the solution proposed in accordance of the present invention, cannot be achieved using a merely tilted connection piece 7 in accordance with the representation from the related art in FIG. 1, so that the high-pressure resistance of this injector is already exhausted.

What is claimed is:

1. An injector for injecting fuel into a combustion chamber of an internal combustion engine, comprising:

an actuator configured to actuate the injector;

an injector body;

a central chamber formed in the injector body;

a connector for connecting the central chamber to a high-pressure source, the connector including an end face;

a control chamber;

a nozzle needle arranged to be activated by fuel that is under high pressure entering into the control chamber via the central chamber;

a plurality of supply-line bores formed in the injector body between the central chamber and the end face, the supply-line bores having diameters many times smaller than a diameter of the central chamber;

an injection nozzle;

a nozzle supply-line leading to the injection nozzle; and a further bore configured in the end face to act directly upon the nozzle supply-line.

2. The injector according to claim 1, wherein the supply-line bores run generally in a parallel orientation with respect to each other.

3. The injector according to claim 1, wherein the supply-line bores run at an angle of tilt with respect to a line of symmetry of the connector.

4. The injector according to claim 3, wherein the supply-line bores are configured to discharge tangentially within boundaries of the central chamber.

5. The injector according to claim 1, wherein the central chamber is an annular chamber.

6. The injector according to claim 1, wherein the central chamber includes a central bore in the injector body.

7. The injector according to claim 1, wherein the further bore is configured to discharge in a ½ hole pattern between the supply-line bores.

8. The injector according to claim 7, wherein the further bore is arranged on the end face above the supply-line bores.

9. The injector according to claim 7, wherein the further bore is arranged on the end face beneath the supply-line bores.

* * * * *

UNITED STATES PATENT AND TRADEMARK OFFICE

CERTIFICATE OF CORRECTION

PATENT NO. : 6,814,301 B1
DATED : November 9, 2004
INVENTOR(S) : Friedrich Boecking It is certified that error appears in the above-identified patent and that said Letters Patent is hereby corrected as shown below:

Title page,
Item [57], ABSTRACT,
Line 1, change "The present invention relates to an injector" to -- An injector is described --.
Lines 3-10, delete "(1) (29) (5, 44) (3) (4) (5, 44) (7) (13) (5, 44) (38) (7) (30, 31) (33, 34)"
Lines 11-12, change "diameters (36, 45) of the central chamber (5, 44)." to -- diameters of the central chamber. --.

Column 1,
Line 5, change "Field of the Invention" to -- Background Information --.
Line 8, change "are increasingly used" to -- may be increasingly used --.
Line 10, change "that permanently acts" to -- that may permanently act --.
Line 12, change "level is maintained" to -- level may be maintained --.
Lines 13-14, change "is conveyed to" to -- may be conveyed to --.
Line 14, change "which are assigned" to -- which may be assigned --.
Line 17, change "are being placed" to -- may be placed --.
Line 22, change "Background Information" to -- Field of the Invention --.
Line 23, change "German Patent" to -- German Patent Application No. --.
Line 23, change "A1 relates to" to -- describes --.
Line 24, change "value is proposed" to -- value is described --.
Line 25, change "is configured" to -- may be configured --.
Line 26, change "which has" to -- which may have --.
Line 27, change "is guided in a sliding bloc." to -- may be guided in a sliding block. --.
Line 27, change "to avoid a backlash" to -- to avoid a rebound --.
Line 29, change "device is provided" to -- device may be provided --.
Lines 30-31, change "it is possible ... the necessary" to -- the required --.
Line 32, change "value." to -- value may be precisely maintained and reproduced. --.
Line 32, change "is designed" to -- may be configured --.
Line 36, change "chamber is" to -- chamber may be --.
Line 38, change "thus making it possible to achieve" to -- so that --.
Line 39, change "a fuel injector." to -- a fuel injector may be achieved. --.
Line 41, change "that can be achieved" to -- that may be achieved --.
Line 41, change "remains" to -- may remain --.
Line 48, change "Presentation of the Invention" to -- Summary of the Invention --.
Line 52, change "the solution" to -- an example solution --.
Line 53, change "proposes executing" to -- may provide --.
Line 54, change "that have an essentially smaller" to -- that may have a generally smaller --.

UNITED STATES PATENT AND TRADEMARK OFFICE

CERTIFICATE OF CORRECTION

PATENT NO. : 6,814,301 B1
DATED : November 9, 2004
INVENTOR(S) : Friedrich Boecking It is certified that error appears in the above-identified patent and that said Letters Patent is hereby corrected as shown below:

Column 1 (cont'd),
Line 55, change "bore, or the" to -- central bore, or the --.
Line 55, change "The advantage of this solution," to -- The example solution, --.
Line 56, change "which favorably influences" to -- which may desirably influence --.
Line 57, change "injector, can be seen in the fact that" to -- injector because --.
Line 58, change "can be configured" to -- may be configured --.
Line 58, change "having an essentially" to -- having a generally --.
Line 59, change "that can be" to -- that may be --.
Line 62, change "the more favorable will be" to -- the more desirable --.
Line 66, change "can run parallel" to -- may run parallel --.
Line 67, change "injector body, in addition," to -- injector body. In addition, --.
Line 67, delete "it is also possible to arrange".

Column 2,
Line 1, change "bores to run" to -- bores may be arranged to run --.
Line 3, change "can be selected" to -- may be selected --.
Lines 10-11, delete "it is possible to configure in the injector body".
Line 12, change "a smaller diameter" to -- a smaller diameter, --.
Lines 13-14, change "it being possible to configure" to -- may be configured in the injector body, so that --.
Line 15, change "supply-line bores" to -- supply-line bores may be configured --.
Line 22, change "can be significantly increased." to -- may be significantly increased. --.
Lines 24-25, delete "it is possible to achieve".
Line 25, change "resistance reserves." to -- resistance reserves may be achieved. --.
Line 30, change "Drawing" to -- Brief Description of the Drawing --.
Line 32, delete "On the basis ... are the contents:".
Line 35, change "FIG. 1 depicts a fuel injector known from the related art" to -- FIG. 1 shows a conventional fuel injector --.
Line 36, change "high-pressure connection," to -- high-pressure connection. --.
Line 37, change "FIG. 2 depicts" to -- FIG. 2 shows --.
Lines 39, 46 and 48, change "the injector body," to -- the injector body. --.
Line 40, change "FIG. 3 depicts" to -- FIG. 3 shows --.
Line 41, change "according to FIG. 2" to -- according to FIG. 2 --.
Line 43, change "FIG. 4 depicts the" to -- FIG. 4 shows a --.
Line 44, change ""A-A"," to -- "IV-1V." --.
Line 45, change "FIG. 5.1 depicts a design variant" to -- FIG. 5.1 shows an example embodiment --.

UNITED STATES PATENT AND TRADEMARK OFFICE

CERTIFICATE OF CORRECTION

PATENT NO. : 6,814,301 B1
DATED : November 9, 2004
INVENTOR(S) : Friedrich Boecking It is certified that error appears in the above-identified patent and that said Letters Patent is hereby corrected as shown below:

Column 2, (cont'd,)
Line 47, change "FIG. 5.2 depicts a further design variant" to -- FIG. 5.2 shows a further example embodiment --.
Line 49, change "FIGS. 5.3+5.4 depict" to -- FIGS. 5.3 and 5.4 show --.
Line 51, change "pattern, and" to -- pattern. --.
Line 52, change "FIG. 6 depicts" to -- FIG. 6 shows --.
Line 55, change "Design Variants" to -- Detailed Description --.
Lines 57-58, change "FIG. 1 depicts . . . high-pressure connection" to -- FIG. 1 shows a conventional fuel injector that has a tilted high-pressure connection. --.
Line 59, delete "which is known from the related art,".
Line 61, change "can be relieved" to -- may be relieved --.

Column 3,
Line 3, change "filter element 6, here indicated" to -- filter element 6, which is shown --.
Line 24, change "pressure can be" to -- pressure may be --.
Line 26, change "is here indicated" to -- is shown --.
Line 26, delete "very".
Line 31, change "opposite end face 22" to -- opposite to end face 22 --.
Lines 47-48, delete "it is possible to introduce".
Line 48, change "bore 32" to -- bore 32 may be introduced --.
Line 51, change "FIG. 2, can" to -- FIG. 2 may --.
Line 54, change "FIG. 3 depicts" to -- FIG. 3 shows --.
Line 55, change "as shown in" to -- shown in --.
Line 57, change "depicted in FIG. 3" to -- shown in FIG. 3 --.

Column 4,
Line 2, change "is depicted here," to -- is shown here, --.
Line 6, change "FIG. 4 depicts" to -- FIG. 4 shows --.
Line 6, change "Section A–A" to -- Section IV–IV --.
Line 8, change "can be seen" to -- may be seen --.
Line 9, change "can optionally be" to -- may optionally be --.
Lines 19-20, change "shows a design variant" to -- shows an example embodiment --.
Line 32, change "depicts a further design variant of the" to -- shows a further example embodiment of a --.
Line 42, change "design variant," to -- example embodiment, --.
Line 43, change "can be configured" to -- may be configured --.
Line 44, change "thread 37 can" to -- thread 37 may --.
Line 45, change "the design variant" to -- the example embodiment --.
Line 46, change "bores 30, 31 can be" to -- bores 30, 31 may be --.

UNITED STATES PATENT AND TRADEMARK OFFICE

CERTIFICATE OF CORRECTION

PATENT NO. : 6,814,301 B1
DATED : November 9, 2004
INVENTOR(S) : Friedrich Boecking It is certified that error appears in the above-identified patent and that said Letters Patent is hereby corrected as shown below:

Column 4, (cont'd),
Line 53, change "is limited by" to -- may be limited by --.
Line 63, change "depicted in a top view" to -- shown in a top view --.
Line 65, change "pattern is designated" to -- pattern is indicated --.

Column 5,
Line 1, change "FIG. 5.4 is" to -- FIG. 5.4 may --.
Line 3, change "this design variant" to -- this example embodiment --.
Line 4, change "is situated at" to -- is arranged at --.
Line 8, change "FIG. 6 depicts" to -- FIG. 6 shows --.
Line 9, change "in this design variant" to -- in this example embodiment --.
Line 21, delete "extremely".
Line 23, change "in the design variants" to -- in the example embodiments --.
Line 25, change "is the advantage" to -- is the feature --.
Line 30, change "that can be" to -- that may be --.
Line 32, change "the better is the" to -- the more desirable the --.
Line 33, change "fuel injector." to -- fuel injector may be. --.
Line 36, change "can be achieved." to -- may be achieved. --.
Line 37, change "the solution proposed" to -- a solution proposed --.
Line 38, change "offers a potential resistance" to -- may offer a potential resistance --.
Line 39, change "which will be required" to -- which may be required --.
Line 40, change "are promised" to -- may be promised --.
Line 42, change "which is inherent" to -- which may be inherent --.
Line 44, change "cannot be achieved" to -- may not be achieved --.

Signed and Sealed this

Sixth Day of September, 2005

JON W. DUDAS
*Director of the United States Patent and Trademark Office*